US006644369B1

(12) United States Patent
Chiang

(10) Patent No.: US 6,644,369 B1
(45) Date of Patent: Nov. 11, 2003

(54) CUTTER UNIT FOR A WOOD PLANING MACHINE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 10/289,692

(22) Filed: Nov. 7, 2002

(30) Foreign Application Priority Data

Jul. 23, 2002 (TW) ..... 91211223 U

(51) Int. Cl.[7] ..... B27C 5/00

(52) U.S. Cl. ..... 144/230; 144/117.1; 144/218; 144/134.1; 144/241; 407/38; 407/37; 407/41; 407/49

(58) Field of Search ..... 144/162.1, 172, 144/173, 174, 218, 221, 229, 230, 241, 114.1, 117.1, 134.1; 407/35, 37, 38, 40, 45, 46, 47, 49, 41; 241/36, 242, 294

(56) References Cited

U.S. PATENT DOCUMENTS 4,429,726 A * 2/1984 Betzler ..... 144/230 X
5,163,490 A * 11/1992 Meis ..... 144/230
6,092,571 A * 7/2000 Liao ..... 144/117.1
6,095,211 A * 8/2000 Chiang ..... 407/41 X
6,119,741 A * 9/2000 Rowe et al. ..... 144/230

* cited by examiner

*Primary Examiner*—W. Donald Bray
(74) *Attorney, Agent, or Firm*—Trop, Pruner & Hu, P.C.

(57) ABSTRACT

A cutter unit includes two positioning bars mounted securely in a retaining groove of a rotating axle to define a cutter-receiving chamber therebetween. A cutter positioning block is disposed in the chamber. A first side face of the cutter positioning block is formed with a cutter-holding recess to receive a cutter. The recess is defined by a recess-confining wall with two opposing wall portions abutting against two end faces of the cutter. A side face of the cutter is disposed outwardly of the recess. An adjusting unit is disposed between and abuts against a second side face of the cutter positioning block and one of two wall portions of the retaining groove, and is adjustable to move the cutter positioning block and the cutter so as to press the cutter against the other one of the wall portions of the retaining groove.

2 Claims, 5 Drawing Sheets

CUTTER UNIT FOR A WOOD PLANING MACHINE

CROSS REFERENCE TO RELATED APPLICATION

This application claims priority of Taiwanese Application No. 091211223, filed on Jul. 23, 2002.

BACKGROUND OF THE INVENTION

1. Field of the Invention

The present invention relates to a cutter unit, more particularly to a cutter unit for a wood planing machine.

2. Description of the Related Art

Referring to FIGS. 1 and 2, a conventional cutter unit for a wood planing machine is shown to include a rotating axle 13, a planing cutter 17, two positioning bars 14, and a forming cutter set.

As illustrated, the axle 13 includes an axle body 131 formed with an axially extending retaining groove 132 confined by a groove-confining wall 133W that has two opposing inclined wall portions 134, 135 and a bottom wall portion 133 interconnecting the inclined wall portions 134, 135. The planing cutter 17 is disposed within the retaining groove 132 in the axle body 131. The positioning bars 14 are disposed securely in the retaining groove 132 to press the planing cutter 17 against one of the inclined wall portions 134, 135 of the retaining groove 132 so as to prevent disengagement of the planing cutter 17 from the retaining groove 132. The positioning bars 14 respectively have opposing end faces 140 that are spaced apart from each other to define a cutter receiving chamber 132C therebetween. The forming cutter set is disposed in the cutter receiving chamber 132C, and includes a forming cutter 1 with a cutting edge 11, a cutter positioning block 15, and two fastener screws 16. The cutter positioning block 15 is disposed in the cutter receiving chamber 132C, and has two opposite end faces 151 respectively abutting against the opposing end faces 140 of the positioning bars 14, and two opposite inclined side faces 152, 153. The forming cutter 1 is disposed in the cutter receiving chamber 132C between the cutter positioning block 15 and the planing cutter 17. The fastener screws 16 extend respectively through two threaded holes 156 in the cutter positioning block 15, and are threadedly engaged within two threaded holes 136 in the bottom wall portion 133 of the groove-confining wall 133W, respectively, such that tightening of the fastener screws 16 results in an upward movement of the cutter positioning block 15 relative to the retaining groove 132, which, in turn, results in pressing of the forming cutter 1 against the planing cutter 17, thereby securing the forming cutter 1 in the cutter receiving chamber 132C.

Some disadvantages resulting from the use of the aforesaid conventional cutter unit are as follows:

(1) Since the forming cutter 1 is juxtaposed with the planing cutter 17, the user is exposed to injury during mounting and dismantling of the forming cutter 1 into and from the cutter receiving chamber 132C.

(2) During tightening operation of the fastener screws 16, the forming cutter 1 may wobble and move upwardly and downwardly in the cutter receiving chamber 132C, thereby resulting in an inaccurate positioning of the forming cutter 1 within the cutter receiving chamber 132C.

SUMMARY OF THE INVENTION

Therefore, the object of this invention is to provide a cutter unit for use in a wood planing machine, the cutter unit having a cutter positioning block by the use of which the aforementioned disadvantages can be avoided.

Accordingly, a cutter unit for a wood planing machine of the present invention includes: a rotating axle formed with an axially extending retaining groove confined by a groove-confining wall that has two opposing wall portions; two positioning bars mounted securely in the retaining groove and respectively having opposing end faces that are spaced apart from each other to define an axially extending cutter-receiving chamber therebetween; and a cutter set mounted detachably in the cutter-receiving chamber. The cutter set includes a cutter with two opposite end faces and two opposite abutting side faces, and a cutter positioning block having two opposite end faces respectively abutting against the opposing end faces of the positioning bars, and two opposite first and second side faces. The first side face of the cutter positioning block is indented to form a cutter-holding recess that receives the cutter therein and that is defined by a recess-confining wall with two opposing wall portions. The opposite end faces of the cutter respectively abut against the wall portions of the recess-confining wall of the cutter positioning block. One of the abutting side faces of the cutter is distal from the cutter positioning block, and is disposed outwardly of the cutter-holding recess. The other one of the abutting side faces of the cutter abuts against the recess-confining wall of the cutter positioning block. The cutter set further includes an adjusting unit that is disposed between and that abuts against the second side face of the cutter positioning block and one of the wall portions of the groove-confining wall of the retaining groove and that is adjustable to move the cutter positioning block and the cutter in a transverse direction relative to the wall portions of the groove-confining wall so as to press the one of the abutting side faces of the cutter against the other one of the wall portions of the groove-confining wall of the retaining groove, thereby securing the cutter in the cutter-receiving chamber.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
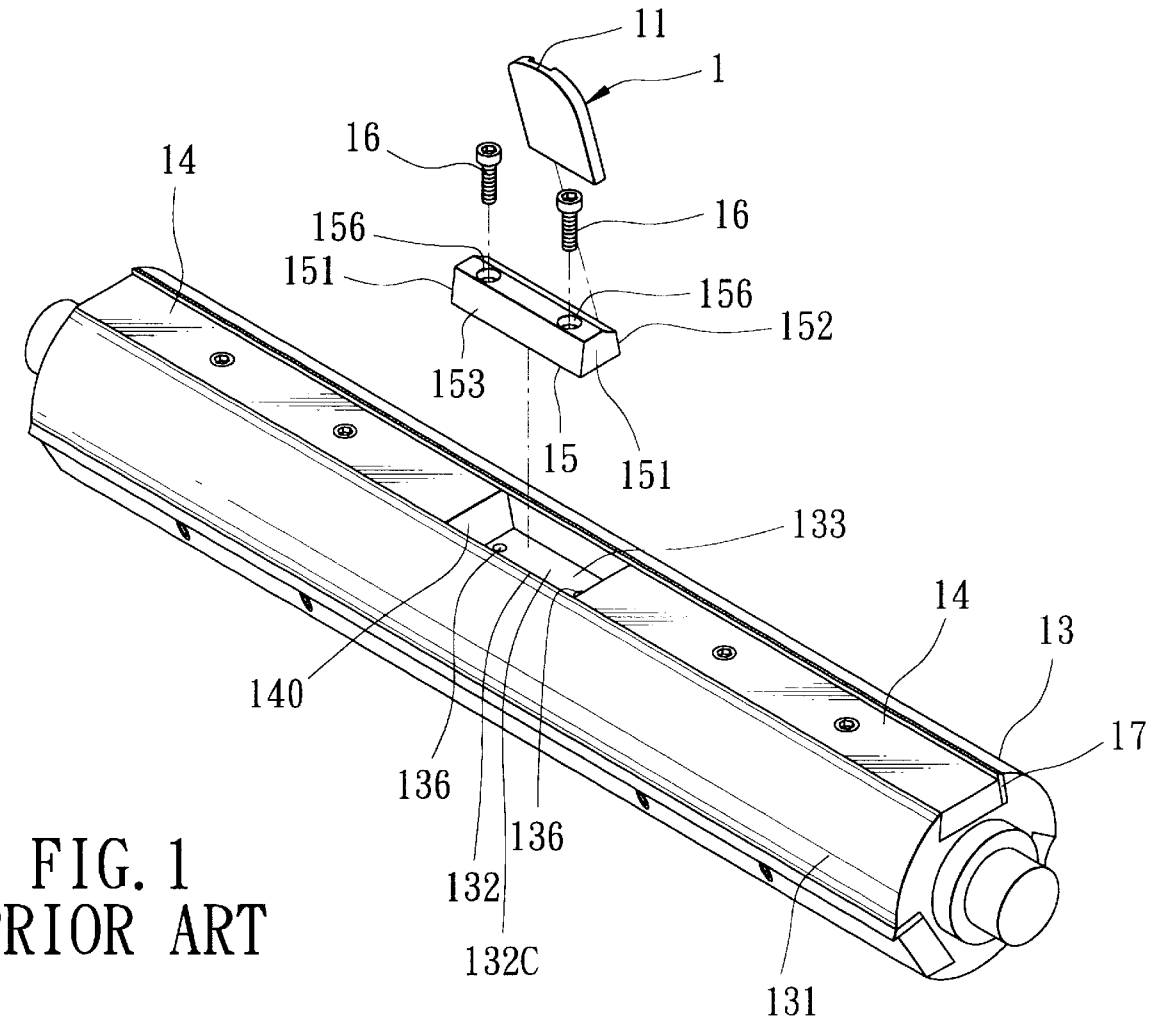
FIG. 1 PRIOR ART
FIG. 1 is a perspective view of a conventional cutter unit for a wood planing machine.
Figure 2:
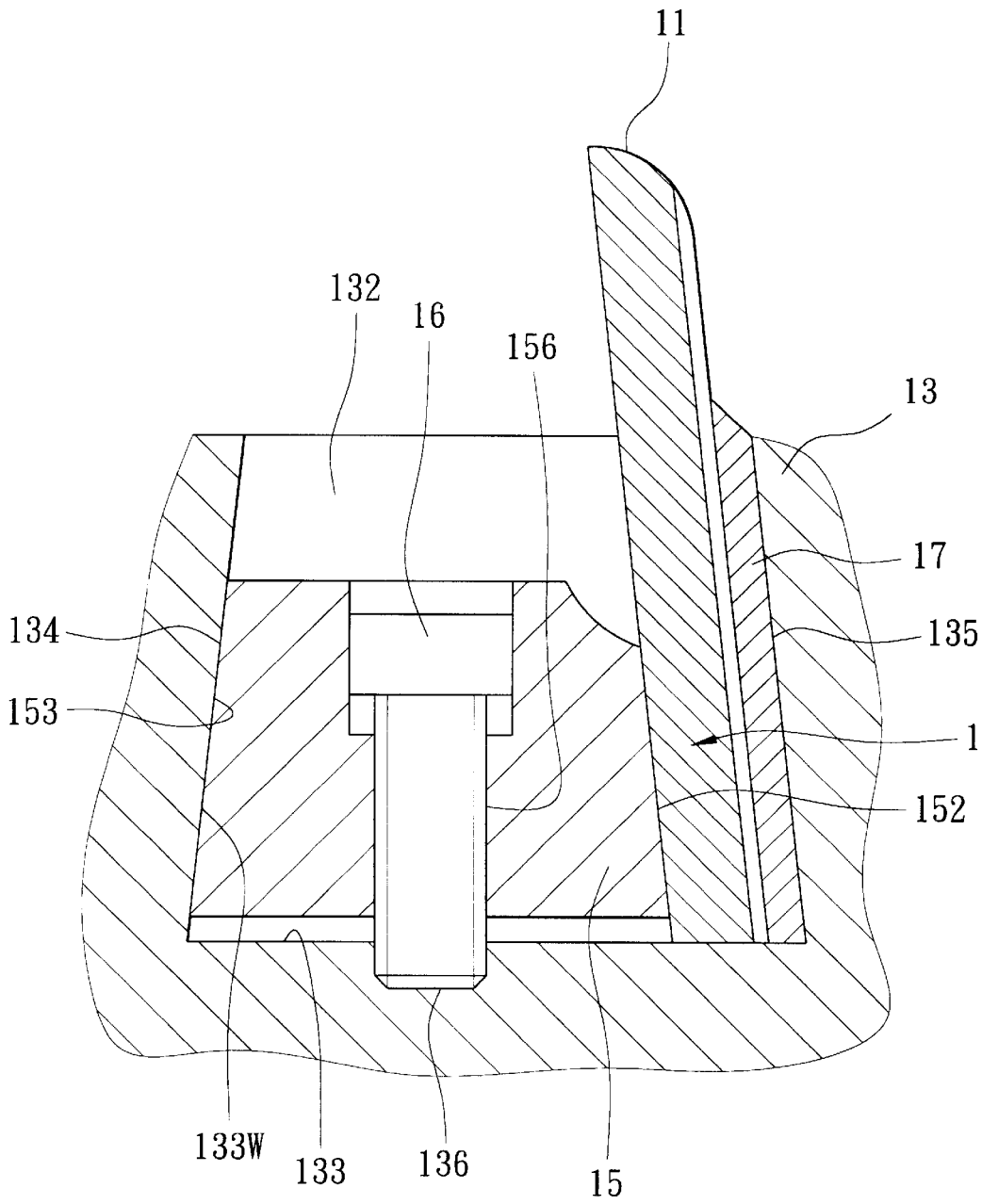
FIG. 2 PRIOR ART
FIG. 2 is a fragmentary sectional view of the conventional cutter unit.
Figure 3:
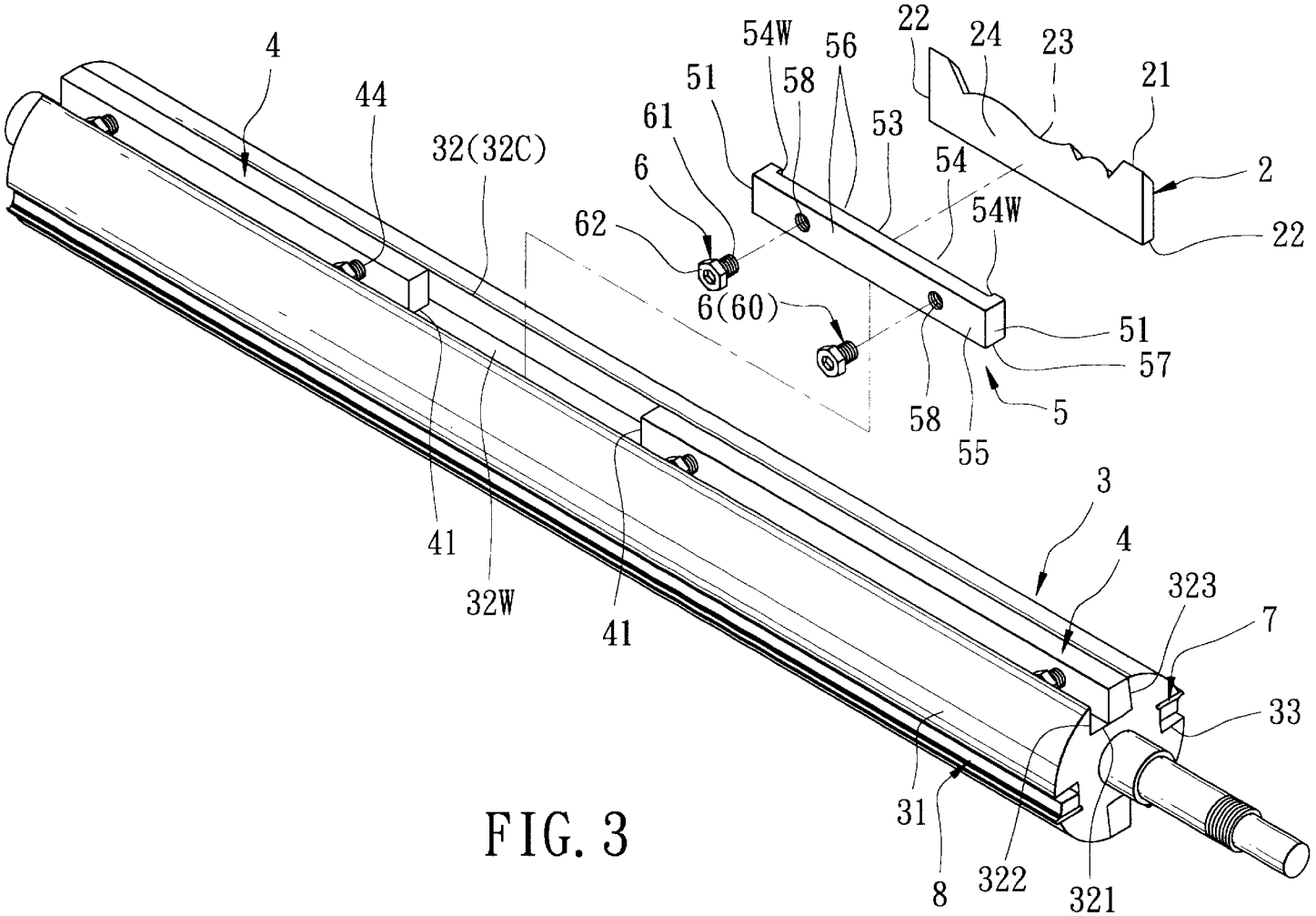
FIG. 3 is a partly exploded view of a preferred embodiment of a cutter unit according to the present invention.
Figure 4:
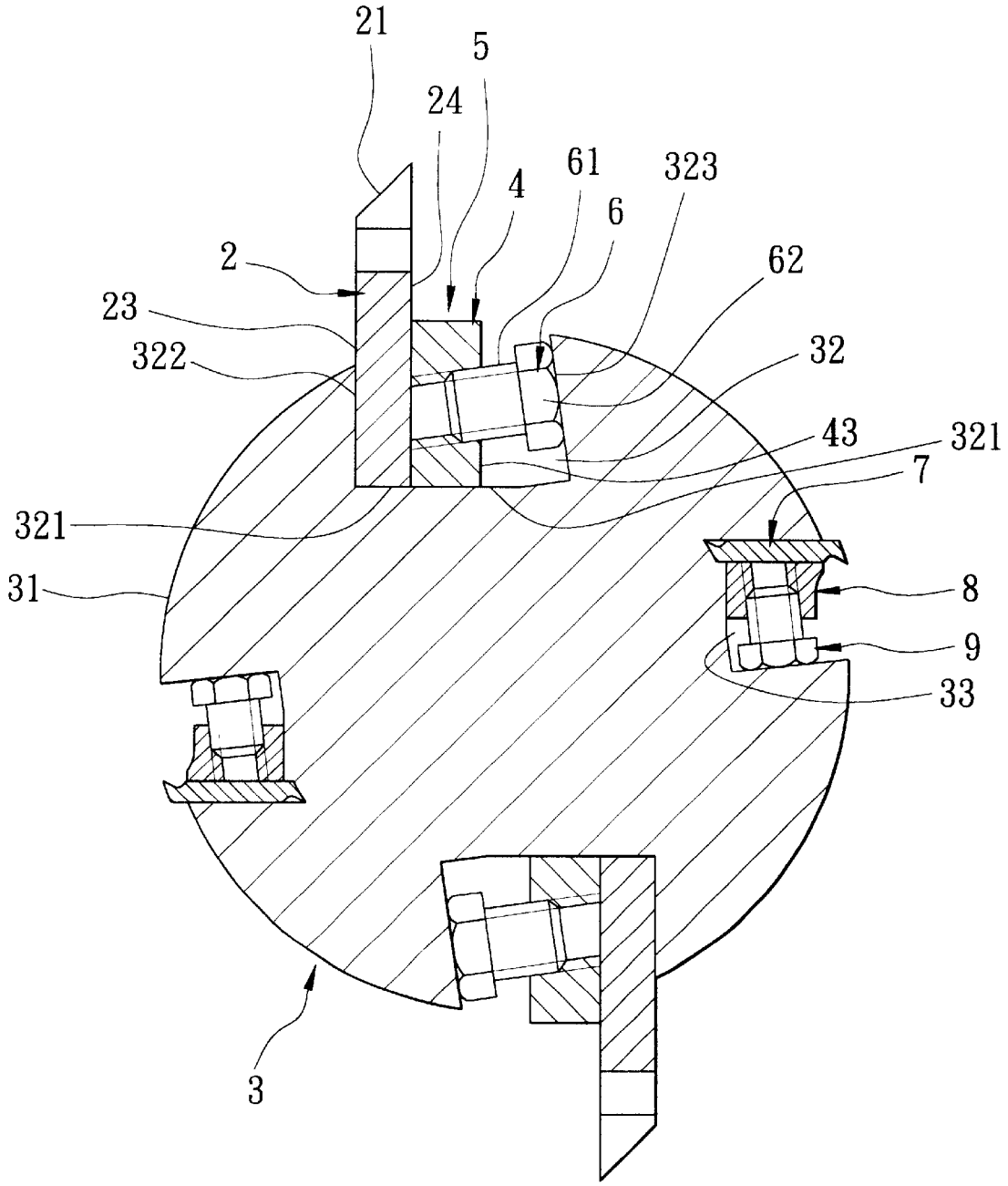
FIG. 4 is a sectional view of the preferred embodiment shown in FIG. 3.
Figure 5:
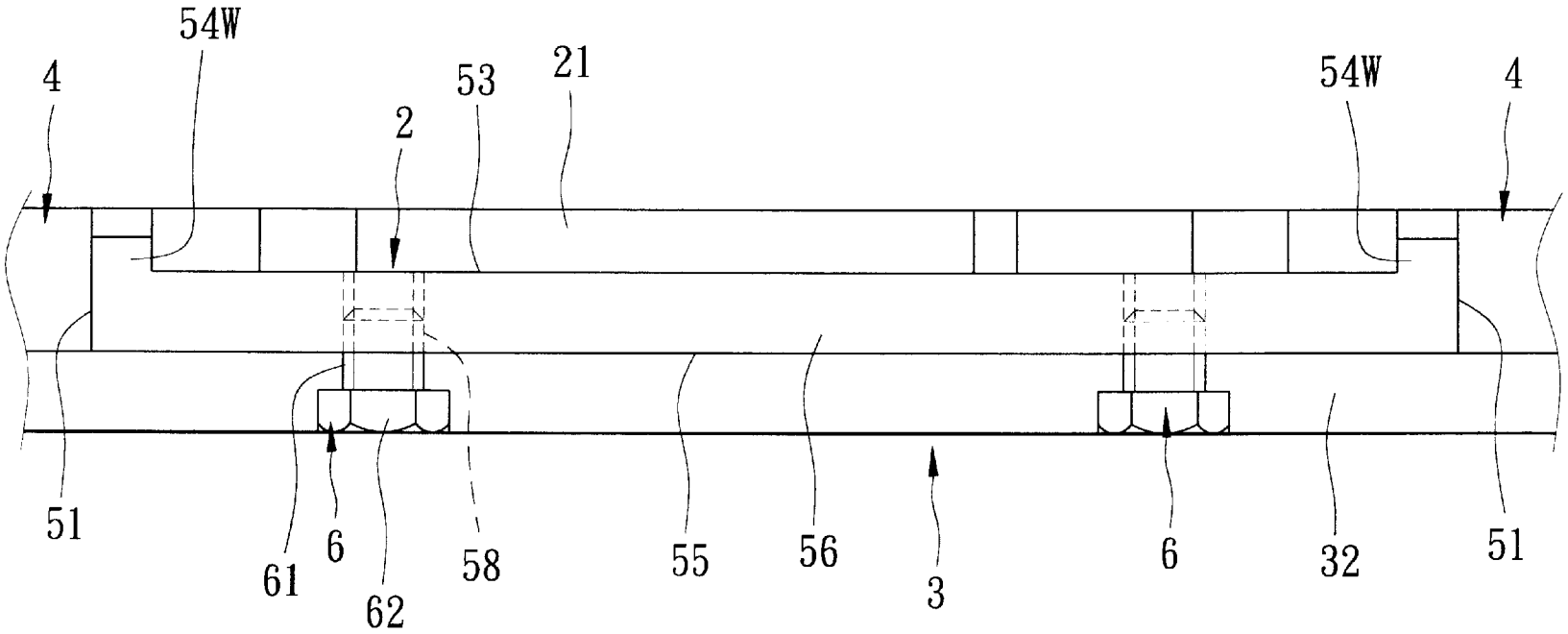
FIG. 5 illustrates how a cutter is retained securely in a cutter-receiving chamber of the preferred embodiment.

Referring to FIGS. 3 to 5, the preferred embodiment of a cutter unit for a wood planing machine according to the present invention is shown to include a rotating axle 3, two pairs of positioning bars 4, and two cutter sets.

As illustrated, the rotating axle 3 includes an axle body 31 formed with two axially extending retaining grooves 32, each of which is confined by a groove-confining wall 32W that has two opposing wall portions 322, 323 and a bight portion 321 interconnecting the wall portions 322, 323.

The two pairs of the positioning bars 4 are mounted securely and respectively in the retaining grooves 32 via the screws 44. The positioning bars 4 of each pair respectively have two opposing end faces 41 that are spaced apart from each other to define an axially extending cutter-receiving chamber 32C therebetween.

Each of the cutter sets is mounted detachably in the respective cutter-receiving chamber 32C, and includes a forming cutter 2, a cutter positioning block 5, and an adjusting unit 6. The forming cutter 2 has two opposite end faces 22 and two opposite abutting side faces 23, 24. The cutter positioning block 5 has two opposite end faces 51 respectively abutting against the opposing end faces 41 of the respective pairs of the positioning bars 4, and two opposite first and second side faces 56. The first side face 56 of the cutter positioning block 5 is indented to form a cutter-holding recess 53 that receives the forming cutter 2 therein and that is defined by a recess-confining wall 54 with two opposing wall portions 54W. When the forming cutter 2 is received in the cutter-holding recess 53, the opposite end faces 22 of the forming cutter 2 respectively abut against the wall portions 54W of the recess-confining wall 54 of the cutter positioning block 5. At this time, the abutting side face 23 of the cutter 2 is distal from the cutter positioning block 5, and is thus disposed outwardly of the cutter-holding recess 53 (see FIG. 3) while the abutting side face 24 of the forming cutter 2 abuts against the recess-confining wall 54 of the cutter positioning block 5, as best shown in FIG. 4. The adjusting unit 6 is disposed between and abuts against the second side face 56 of the cutter positioning block 5 and the wall portion 322 of the retaining groove 32. The adjusting unit 6 is adjustable to move the cutter positioning block 5 and the forming cutter 2 in a transverse direction relative to the wall portions 322, 323 of the retaining groove 32 so as to press the abutting side face 23 of the forming cutter 2 against the wall portion 323 of the groove-confining wall 32W of the retaining groove 32, thereby securing the forming cutter 2 in the cutter-receiving chamber 32C. Under this condition, a cutting edge 21 of the forming cutter 2 is exposed outwardly from the respective cutter receiving chamber 32C.

In this preferred embodiment, the second side face 56 of each of the cutter positioning blocks 5 is formed with two threaded holes 58 that extend in the transverse direction. Each of the adjusting units 6 includes two headed screws 60 that have two threaded shanks 61 extending threadedly and respectively into the threaded holes 58 in the respective cutter positioning block 5, and two enlarged heads 62 abutting against the wall portion 322 of the respective groove-confining wall 32W.

Note that the cutter-holding recess 53 in each cutter positioning block 5 is intended for a particular forming cutter. When it is desired to use another forming cutter of a different size, a matching cutter positioning block has to be utilized so as to prevent wobbling or movement of the forming cutter therewithin during the tightening of the headed screws 60 in the threaded holes 58 in the cutter positioning block 5, thereby maintaining the correct position of the forming cutter 2 in the respective cutter receiving chamber 32C.

Preferably, the axle body 31 of the rotating axle 3 is further formed with two axially extending retaining grooves 33. Two planing cutters 7 are respectively disposed in the retaining grooves 33, and are secured therein by the use of cutter positioning blocks 8 and adjusting units 9 that are similar in constructions to the cutter positioning block 5 and the adjusting unit 6 described hereinabove.

Since the forming cutters 2 and the planing cutters 7 are separately mounted on the rotating axle 3, when it is desired to use the planing cutters 7, the forming cutters 2 can be removed from the rotating axle 3, thereby ensuring the safety of the operator.

With this invention thus explained, it is apparent that numerous modifications and variations can be made without departing from the scope and spirit of this invention. It is therefore intended that the invention be limited only as indicated in the appended claims.

I claim:

1. A cutter unit for a wood planing machine, comprising:

a rotating axle formed with an axially extending retaining groove confined by a groove-confining wall that has two opposing wall portions;

two positioning bars mounted securely in said retaining groove, and respectively having opposing end faces that are spaced apart from each other to define an axially extending cutter-receiving chamber therebetween; and a cutter set mounted detachably in said cutter-receiving chamber, and including a cutter with two opposite end faces and two opposite abutting side faces, and a cutter positioning block having two opposite end faces respectively abutting against said opposing end faces of said positioning bars, and two opposite first and second side faces, said first side face of said cutter positioning block being indented to form a cutter-holding recess that receives said cutter therein and that is defined by a recess-confining wall with two opposing wall portions, said opposite end faces of said cutter respectively abutting against said wall portions of said recess-confining wall of said cutter positioning block, one of said abutting side faces of said cutter being distal from said cutter positioning block and being disposed outwardly of said cutter-holding recess, the other one of said abutting side faces of said cutter abutting against said recess-confining wall of said cutter positioning block, said cutter set further including an adjusting unit that is disposed between and that abuts against said second side face of said cutter positioning block and one of said wall portions of said groove-confining wall of said retaining groove and that is adjustable to move said cutter positioning block and said cutter in a transverse direction relative to said wall portions of said groove-confining wall so as to press said one of said abutting side faces of said cutter against the other one of said wall portions of said groove-confining wall of said retaining groove, thereby securing said cutter in said cutter-receiving chamber.

2. The cutter unit as defined in claim 1, wherein said second side face of said cutter positioning block is formed with two threaded holes extending in said transverse direction, said adjusting unit including two headed screws respectively and threadedly extending into said threaded holes in said positioning block and abutting against said one of said wall portions of said groove-confining wall.

* * * * *